US005183537A

United States Patent [19]

Hergert et al.

[11] Patent Number: 5,183,537

[45] Date of Patent: Feb. 2, 1993

[54] HEADBOX TUBE BANK APPARATUS AND METHOD OF DIRECTING FLOW THERETHROUGH

[75] Inventors: Richard E. Hergert; Richard R. Hergert, both of Rockton; Eugene B. Neill, South Beloit, all of Ill.; Scott B. Pantaleo; Arnold J. Roerig, both of Beloit, Wis.; Thomas D. Rogers, Roscoe, Ill.; Jay A. Shands, Beloit, Wis.; Noriaki Takeguchi, Rockton, Ill.

[73] Assignee: Beloit Technologies, Inc., Wilmington, Del.

[21] Appl. No.: 772,521

[22] Filed: Oct. 7, 1991

[51] Int. Cl.[5] ..... D21F 1/02

[52] U.S. Cl. ..... 162/216; 162/336; 162/343

[58] Field of Search ..... 162/336, 343, 344, 216

[56] References Cited

U.S. PATENT DOCUMENTS

| | | | |
|---|---|---|---|
| 3,135,650 | 6/1964 | Robinson et al. | 162/343 |
| 3,514,372 | 5/1970 | Boyce et al. | 162/343 |
| 3,725,197 | 4/1973 | Dahl et al. | 162/343 |
| 3,923,593 | 12/1975 | Verseput | 162/343 |
| 4,137,124 | 1/1979 | Bubik et al. | 162/343 |
| 4,426,257 | 1/1984 | Antikainen et al. | 162/343 |
| 4,604,164 | 8/1986 | Fujiwara et al. | 162/343 |

*Primary Examiner*—Karen M. Hastings

*Attorney, Agent, or Firm*—Dirk J. Veneman; Raymond W. Campbell; David J. Archer

[57] ABSTRACT

A headbox tube bank apparatus and method of directing flow through same is disclosed for permitting the flow therethrough of stock in a papermaking machine. The apparatus includes a tube bank frame for rigidly supporting the tube bank, the frame defining a plurality of openings. A plurality of tubes cooperate with the frame such that each tube extends through and is supported by an opening. Each tube has an upstream and a downstream portion, the upstream portion defining an internal cross-machine direction section of substantially circular configuration for maximizing the velocity of the stock through the tube. The downstream portion includes a first and a second end with the first end being connected to the upstream portion and the second end defining a downstream orifice having a flow area in a cross-machine direction which is of rectangular configuration for progressively improving the uniformity, stability, cleanliness, and for lowering turbulence of the stock during flow thereof through the downstream portion.

14 Claims, 5 Drawing Sheets

HEADBOX TUBE BANK APPARATUS AND METHOD OF DIRECTING FLOW THERETHROUGH

BACKGROUND OF THE INVENTION

1. Field of the Invention

The present invention relates to a headbox tube bank apparatus and method for improving the flow therethrough of stock in a papermaking machine. More particularly, the present invention relates to a headbox tube bank apparatus for improving the uniformity, stability, cleanliness, and lowering the turbulence of the stock during flow thereof through each tube and nozzle thereof.

2. Information Disclosure Statement

In the papermaking art, paper pulp, otherwise known as stock or furnish, is ejected under high pressure from a headbox onto a moving screen. Water drains from the stock through the screen such that a web of paper is formed on the upper surface of the screen.

More particularly, the headbox includes a slice chamber having an upstream and a downstream end. The downstream end of the slice chamber defines a slice lip which is adjustable such that the curtain of stock ejected from the headbox may be adjusted so that the stock contacts the screen at the optimum angle and with a relatively uniform thickness in a cross-machine direction.

The stock flows into the slice chamber through the upstream end of the slice chamber. Such upstream end is connected to a source of high pressure stock by means of a plurality of tubes arranged such that the pressurized stock flows through the tubes and is evenly distributed into the slice chamber through the upstream end thereof.

Many headboxes have a width in the region of 30 or more feet, and the problem of evenly distributing the pressurized stock through the plurality of tubes or tube bank is considerable.

Several proposals have been made in an attempt to improve the flow stability of the stock flowing through a tube bank. Additionally, attempts have been made in an effort to lower the turbulence of the stock in high speed applications.

Also, in high speed applications, ways have been sought in an attempt to improve the dispersion of fibers within the stock or to evenly distribute the fibers flowing through the tube bank.

Another important feature that is required in a headbox is cleanliness of the headbox such that flow velocities are adequate enough to avoid the collection therein of fibers and contaminants.

Accordingly, the present invention provides a headbox tube bank in which a downstream end thereof has a maximum open area where the stock flows from the tube bank into the slice chamber. Such high open area outlet improves the flow stability of the stock and inhibits the development of undesirable secondary motions or eddies that could otherwise develop in the wake of the main flow.

However, in order to maintain the aforementioned cleanliness within a headbox, it is essential that the stock flow at an extremely high velocity through the individual tubes or nozzles of the tube bank.

Accordingly, it was determined that the tubes should have a relatively small height at the downstream end thereof.

Furthermore, according to the present invention, the tube bank includes a tube design where the flow would change from a circular cross-section at the upstream end of the tube to one of a rectangular cross-section at the downstream end of the tube. Also, the height of the rectangular portion is small compared to the cross-machine directional width of the downstream end or outlet.

However, under such conditions, experimentation indicated that the flow of stock would not normally expand uniformly when undergoing a transition from a circular to a rectangular cross-section. Typically, such flow tends to attach to one or other of the side walls of the rectangular portion, thereby creating a high velocity jet down one side of the tube.

Additionally, another problem that was difficult to resolve was the design of a tube of the aforementioned type that would be relatively easy to manufacture and sufficiently rugged to withstand the relatively hostile environment existing within a headbox of a papermaking machine.

In order to overcome the aforementioned problems, it was determined that in order to achieve a uniform flow in a rectangular duct, the stock flow should first expand from a circular section to a substantially square section. The stock flow would then converge to a higher aspect ratio rectangular section. The term "a high aspect ratio rectangular section" means, according to the present specification, a rectangular section which is relatively wide in a cross-machine direction and relatively low in height.

Although the aforementioned tube design was theoretically correct, such designs were found to be difficult to manufacture and lacked the necessary rigidity.

The aforementioned problem was overcome by the provision of a tube having an initial circular cross-section along the upstream end thereof, such tube having a downstream end of rectangular shape through convergence rather than expansion at the downstream end thereof.

Such convergence of the tube was found to promote a flatter velocity profile and to lower the turbulence level, characteristics that were desirable in a headbox tube bank.

The aforementioned tubes were found to be relatively easy to manufacture through hydraulically pressing a standard tube of the type used in a CONCEPT III headbox. The tube was pressed in an external dye. CONCEPT III is a common law mark of Beloit Corporation.

Moreover, the tubes were arranged in rows with each tube of a row being closely spaced relative to an adjacent tube. The rows were aligned relative to each other in the height direction and adjacent rows were arranged to define therebetween a dove-tail slot for the anchoring therein of an upstream end of a trailing element disposed within the slice chamber.

Also, such trailing elements or vanes defined an increased thickness adjacent to such dove-tail slot such that the stock flow would not slow down on entering the slice chamber.

The aforementioned geometry and trailing element design was found to maintain a high tube and nozzle flow velocity for maintaining cleanliness while promoting a more stable flow therethrough by not allowing significant secondary motion or flow within the main stock flow to occur.

Therefore, it is a primary objective of the present invention to provide a headbox tube bank apparatus which overcomes the aforementioned inadequacies of the prior art arrangements and which makes a considerable contribution to the papermaking art.

Another object of the present invention is the provision of a headbox tube bank apparatus in which each tube defines an upstream portion having a substantially circular configuration such that although the mass flow rate remains constant throughout the tube, the velocity changes in accordance with the change in cross-sectional area along the tube. The aforementioned arrangement maximizes the velocity of the stock flowing through the tube and a downstream orifice which has a substantially rectangular configuration for progressively improving the uniformity, stability, cleanliness, and for lowering the turbulence of the stock during flow thereof through the tube and nozzle thereof.

More particularly, the inlet is circular in order to improve strength and cleanliness. Additionally, the relatively small diameter of the tube increases the velocity of the stock, thereby creating sufficient resistance for cross-machine uniformity.

Another object of the present invention is the provision of a headbox tube bank apparatus in which a frame defines a plurality of openings for supporting each tube of the tube bank so that the openings are disposed in vertically spaced rows, each adjacent row defining therebetween a dove-tail shaped slot for the reception therein of a trailing element.

Another object of the present invention is the provision of a headbox tube bank apparatus in which each trailing element has an increase in thickness immediately downstream relative to an anchoring portion disposed within a dove-tail shaped slot for optimizing the stability, dispersion, and cleanliness of stock flow immediately downstream relative to the downstream orifice of each tube.

Another object of the present invention is the provision of a headbox tube bank apparatus in which each tube includes an upstream portion having an upstream and a downstream end, the upstream portion having a circular configuration from the upstream to the downstream end.

Another object of the present invention is the provision of a headbox tube bank apparatus in which each tube includes a downstream portion having an upstream length of substantially uniform flow area in a cross-machine direction and a downstream length having a substantially rectangular flow area which decreases along the length thereof in a flow direction.

Other objects and advantages of the present invention will be apparent to those skilled in the art by a consideration of the detailed description contained hereinafter taken in conjunction with the annexed drawings.

SUMMARY OF THE INVENTION

The present invention relates to a headbox tube bank apparatus and a method for improving the flow therethrough of stock in a papermaking machine. The apparatus includes a tube bank frame for rigidly supporting the tube bank, the frame defining a plurality of openings. A plurality of tubes cooperate with the frame such that each tube of the plurality of tubes extends through, and is supported by, an opening of the plurality of openings. Each tube of the plurality of tubes has an upstream and a downstream portion, the arrangement being such that the stock flows through the tube from the upstream to the downstream portion. The upstream portion defines an internal cross-machine direction section of substantially circular configuration for maximizing the velocity of the stock through the tube.

The downstream portion has a first and a second end with the first end of the downstream portion being connected to the upstream portion.

The second end of the downstream portion defines a downstream orifice or nozzle having a flow area in a cross-machine direction which is of substantially flattened rectangular configuration for progressively improving the uniformity, stability, cleanliness, and for lowering the turbulence of the stock during flow thereof through the downstream portion.

In a more specific embodiment of the present invention, the frame extends in a cross-machine direction across the flow of stock.

Furthermore, the plurality of openings are arranged as a plurality of vertically spaced rows, the arrangement being such that each row includes at least two openings, the openings being spaced closely adjacent to each other.

Each opening of each row is vertically aligned relative to an opening of an adjacent row. Also, each vertically spaced row is disposed relative to an adjacent row for defining therebetween a dove-tail shaped slot which extends substantially horizontally in a cross-machine direction across the tube bank apparatus.

Additionally, the headbox tube bank apparatus includes a plurality of trailing elements with each trailing element having an upstream and a downstream end. The upstream end of each trailing element defines an anchoring portion for slidable cooperation within the dove-tail shaped slot for movably anchoring the upstream end of the trailing element relative to the tube bank frame.

The upstream end of each trailing element increases in thickness immediately downstream relative to the anchoring portion in a direction towards the downstream end of the trailing elements for optimizing stability, dispersion, and cleanliness of stock immediately downstream relative to the downstream orifice.

More specifically, the upstream portion of each tube includes an upstream and a downstream end. The circular configuration of the upstream portion is substantially the same from the upstream to the downstream end of the upstream portion.

Additionally, the first end of the downstream portion is connected to the upstream portion between the upstream and the downstream end of the upstream portion.

The downstream portion of each tube also includes a cylindrical channel which extends from the first end of the downstream portion towards the second end of the downstream portion. The cylindrical channel receives therein the downstream end of the upstream portion such that the first end of the downstream portion is connected to the upstream portion between the upstream and the downstream ends of the upstream portion.

The downstream portion of each tube between the downstream end of the upstream portion and the second end of the downstream portion also includes an upstream length having a substantially uniform flow area in a cross-machine direction along the length thereof.

Additionally, the downstream portion of each tube includes a downstream length having a flow area in a cross-machine direction which is substantially rectangular and which decreases along the length thereof towards the second end of the downstream portion.

Also, the upstream length defines a substantially circular flow area along the length thereof, the circular flow area being greater than the circular flow area defined by the upstream portion.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims. Included amongst such modifications would be the provision of vanes or trailing elements which have a relatively uniform thickness along the length thereof.

BRIEF DESCRIPTION OF THE DRAWINGS

Similar reference characters refer to similar parts throughout the various views of the drawings.

DETAILED DESCRIPTION OF THE INVENTION

Figure 1:
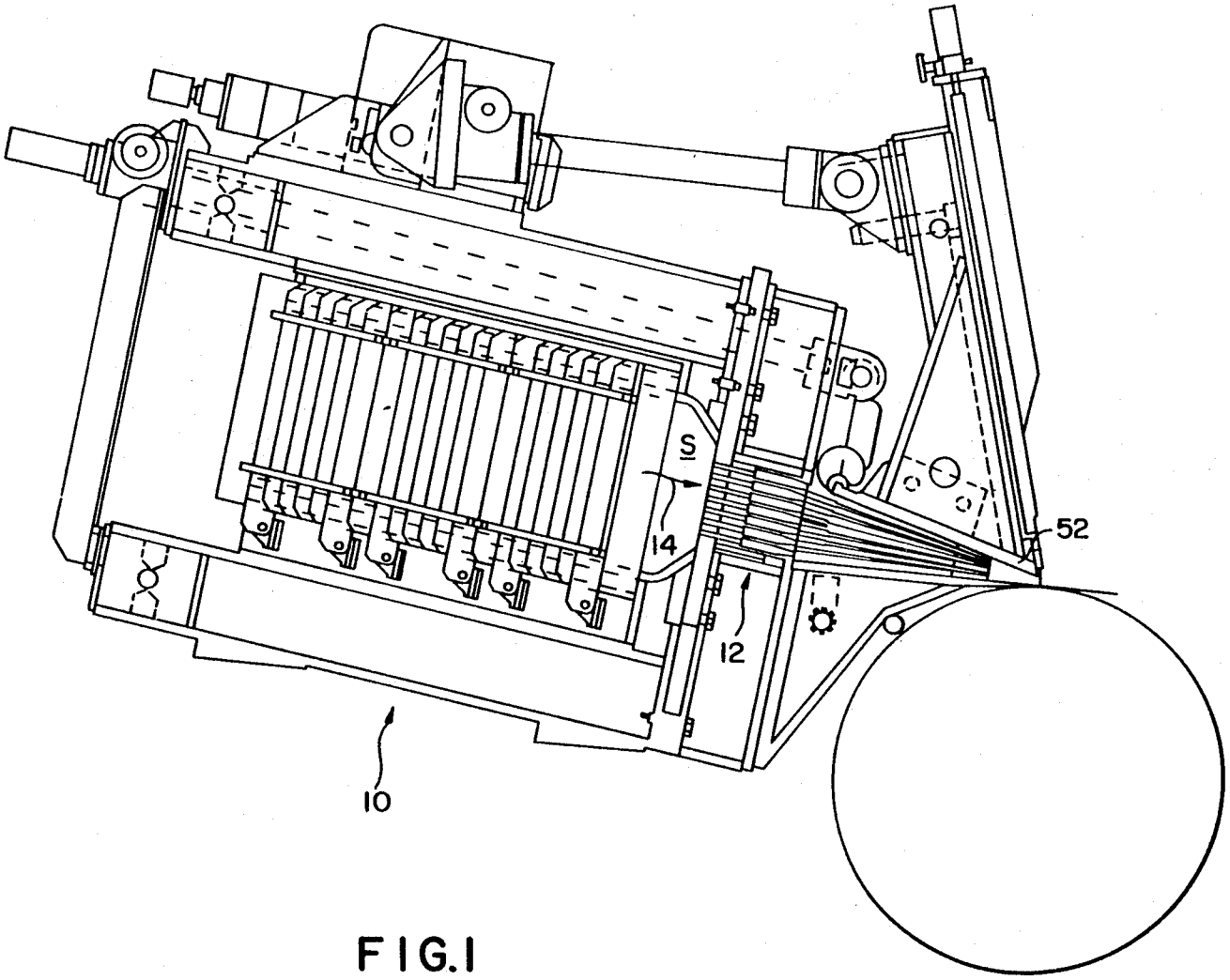
FIG. 1 is a sectional view of a headbox including a headbox tube bank apparatus according to the present invention.

FIG. 1 is a sectional view of a headbox generally designated 10 of a papermaking machine. The headbox 10 includes a headbox tube bank apparatus generally designated 12, according to the present invention, for the flow therethrough, as indicated the arrow 14, of stock S.

Figure 2:
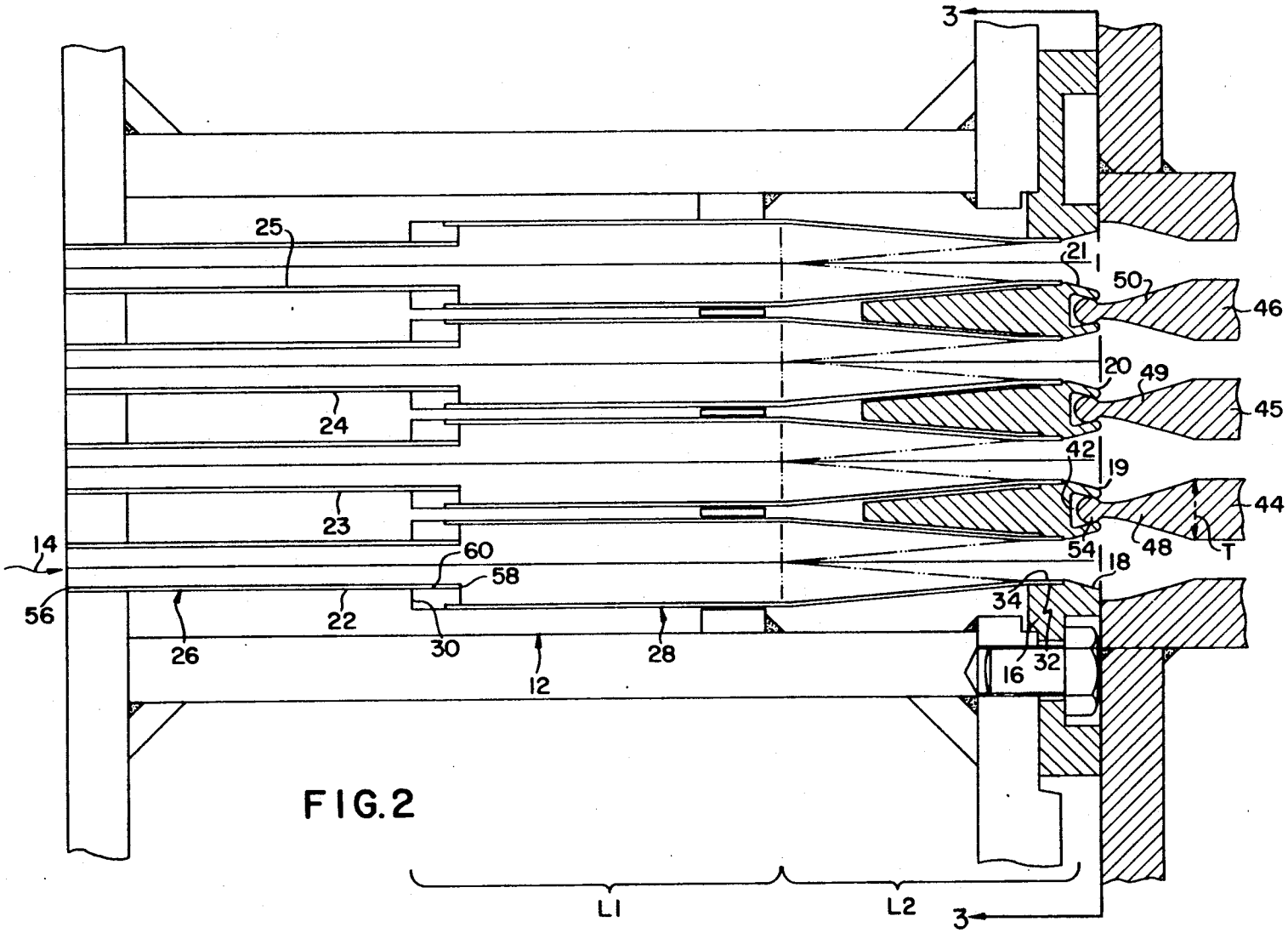
FIG. 2 is an enlarged sectional view of the headbox tube bank apparatus shown in FIG. 1 according to the present invention.

FIG. 2 is an enlarged sectional view of a portion of the apparatus 12 shown in FIG. 1. The apparatus 12 includes a tube bank frame 16 for rigidly supporting the tube bank apparatus 12. The frame 16 defines a plurality of openings 18, 19, 20 and 21.

A plurality of tubes 22, 23, 24 and 25 cooperate with the frame 16 such that each tube of the plurality of tubes 22 to 25 extends through and is supported by an opening of the plurality of openings 18 to 21.

The tube 22 of the plurality of tubes 22 to 25 has an upstream and a downstream portion, generally designed 26 and 28, respectively. The arrangement is such that the stock S flows, as indicated by the arrow 14, through the tube 22 from the upstream portion 26 to the downstream portion 28.

The upstream portion 26 defines an internal cross-machine direction section of substantially circular configuration for maximizing the velocity of the stock S through the tube 22. Although the mass flow rate remains constant throughout the tube, the velocity changes in accordance with the change in cross-sectional area along the tube.

The downstream portion 28 has a first and a second end 30 and 32, respectively. The first end 30 of the downstream portion 28 is connected to the upstream portion 26.

The second end 32 of the downstream portion 28 defines a downstream orifice or nozzle 34 having a flow area in a cross- machine direction, which is of substantially flattened rectangular configuration for progressively improving the uniformity, stability, cleanliness, and for lowering the turbulence of the stock S during flow thereof through the downstream portion 28.

Figure 3:
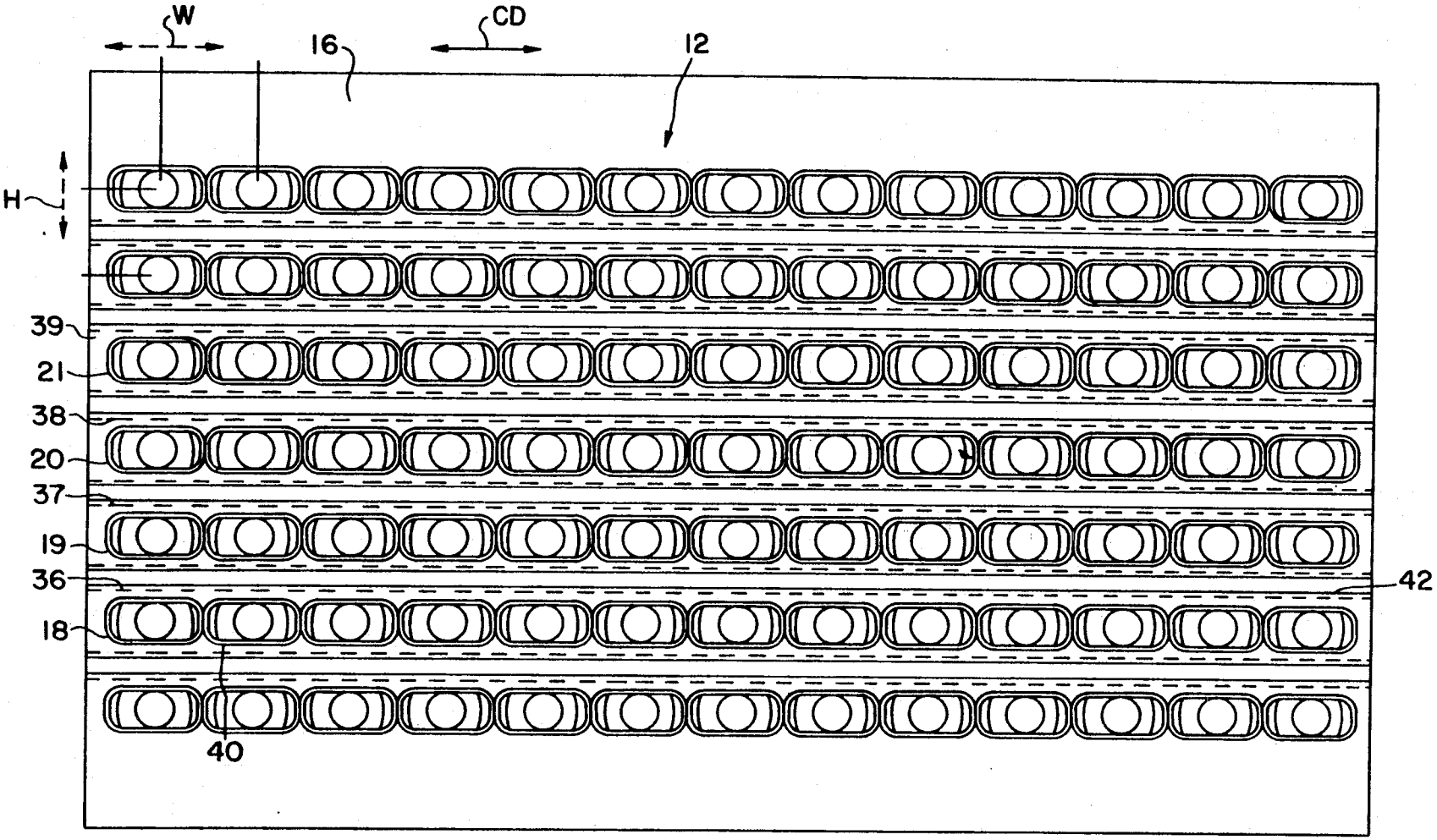
FIG. 3 is a sectional view on an increase scale taken on the line 3—3 of FIG. 2 showing the rows of openings according to the present invention.

FIG. 3 is a sectional view on an increased scale taken on the line 3—3 of FIG. 2 and shows the frame 16 extending in a cross-machine direction, as indicated by the arrow CD, across the flow 14 of stock S.

The plurality of openings 18 to 21 define a plurality of vertically spaced rows 36, 37, 38 and 39.

More specifically, as shown in FIG. 3, each row of the plurality of spaced rows 36–39 includes at least two openings. For example, row 36 includes the openings 18 and 40, openings 18 and 40 being spaced closely adjacent to each other.

Each opening 18, for example, of row 36 is vertically aligned relative to, for example, an opening 19 of an adjacent row 37.

Each vertically spaced row, such as row 36, of the plurality of spaced rows 36 to 39 are disposed relative to an adjacent row, such as row 37, for defining therebetween a dove-tail shaped slot 42 which extends substantially horizontally in a cross-machine direction CD across the tube bank apparatus 12.

Referring back to FIG. 2, FIG. 2 partially shows a plurality of trailing elements 44, 45 and 46. Each trailing element 44 to 46 has an upstream end 48, 49 and 50. Each element also has a downstream end, generally designated 52 in FIG. 1. The upstream end 48 of, for example, trailing element 44, defines an anchoring portion 54 for slidable cooperation within the dove-tail shaped slot 42 for movably anchoring the upstream end 48 of the trailing element 44 relative to the tube bank frame 16.

More specifically, in one embodiment of the present invention the upstream ends 48 to 50 of the trailing elements 44 to 46, respectively, increase in thickness T immediately downstream relative to the anchoring portion 54 in a direction towards the downstream end 52 of the trailing elements 44 to 46 for optimizing the stability and cleanliness and dispersion of stock S immediately downstream relative to the downstream orifice 34.

The upstream portion 26, as shown in FIG. 2, includes an upstream and a downstream end 56 and 58, respectively. The circular configuration of the upstream portion 26 is substantially the same from the upstream to the downstream end 56 and 58, respectively, of the upstream portion 26.

The first end 30 of the downstream portion 28 is connected to the upstream portion 26 between the upstream end 56 and the downstream end 58 of the upstream portion 26.

The downstream portion 28 also includes a cylindrical channel 60 which extends from the first end 30 of the downstream portion 28 towards the second end 32 of the downstream portion 28. The cylindrical channel 60 receives therein the downstream end 58 of the upstream portion 26 such that the first end 30 of the downstream portion 28 is connected to the upstream portion 26 between the upstream end and the downstream end 58 of the upstream portion 26.

The downstream portion 28 between the downstream end 58 of the upstream portion 26 and the second end 32 of the downstream portion 28 also includes an upstream length L1 having a substantially uniform flow area in a cross-machine direction along the length thereof.

Also, the downstream portion 28 includes a downstream length L2 having a flow area in a cross-machine direction which is substantially rectangular and which decreases along the length thereof towards the second end 32 of the downstream portion 28.

More particularly, the circular flow area of the upstream portion 26 is the same along the length thereof.

Similarly, the substantially circular flow area through the upstream length L1 is the same along the length thereof. However, the circular flow area is substantially greater at the upstream length L1 than at the upstream portion 26.

Moreover, the flow area changes along the length of the downstream length L2 from that of a substantially circular flow area of the same size as that defined by the upstream length L1 to a rectangular flow area extending to the second end 32.

The rectangular flow area has a greater width W shown in FIG. 3 than the height H thereof shown in FIG. 3, i.e. this flow area has a flattened rectangular configuration.

Figure 4:
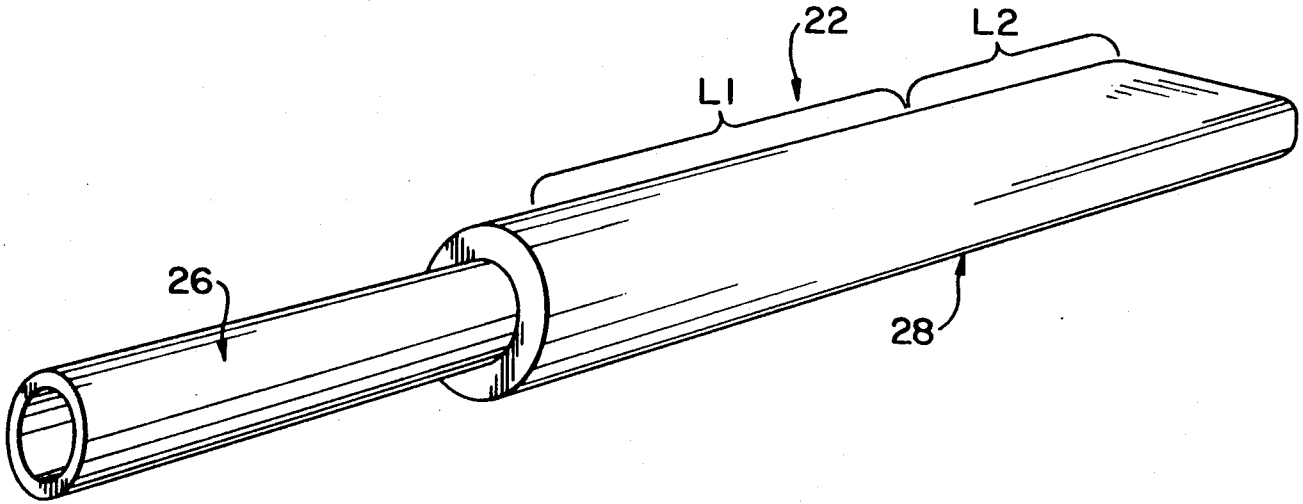
FIG. 4 is a perspective view of a tube of the tube bank apparatus according to the present invention.

FIG. 4 is a perspective view of an individual tube 22 shown in FIG. 2. The tube 22 includes an upstream portion 26 and a downstream portion generally designated 28. The downstream portion includes an upstream length L1 defining a circular flow area, and a downstream length L2 which changes into a substantially rectangular flow area along the length thereof. The downstream portion 26 is an integral continuous element as shown in FIG. 4 and FIG. 2.

In operation of the apparatus, stock S flows, as indicated by the arrow 14, through the plurality of tubes 22 to 25.

In the case of, for example, tube 22, the flow 14 flows at high speed through the upstream portion 26 due to the relatively small flow area thereof.

The flow 14 uniformly enters the upstream length L1 and flows evenly therethrough because L1 defines a circular flow area so that there exists no tendency for the flow to adhere to one or other side wall, as would be the case if L1 were of rectangular configuration.

The stock flow 14 then enters the downstream length L2 where the transition from a circular flow area to a rectangular flow area begins. Normally, there would be a tendency for the flow 14 to adhere to one or other of the side walls of the rectangular length L2, particularly as the width thereof is greater than the height H. However, the arrangement is such that the rectangular flow area progressively decreases towards the second end 32 so that the rate of flow of the stock flow 14 increases along the length L2. Consequently, the stock flow 14 is evenly distributed through the rectangular downstream orifice 34.

Throughout the specification, the statement that the rate of flow of the stock flow increases is to be interpreted that the mass flow rate remains constant along the length of the tube; however, the velocity of the stock increases.

Furthermore, by increasing the thickness T of the trailing elements immediately downstream from the orifice 34, the stock flow 14 is once again increased, thereby avoiding the generation of eddies and secondary motion within the stock.

The dove-tail slots, such as 42, enable anchoring therein of the respective trailing elements while permitting removal thereof as required.

Figure 5:
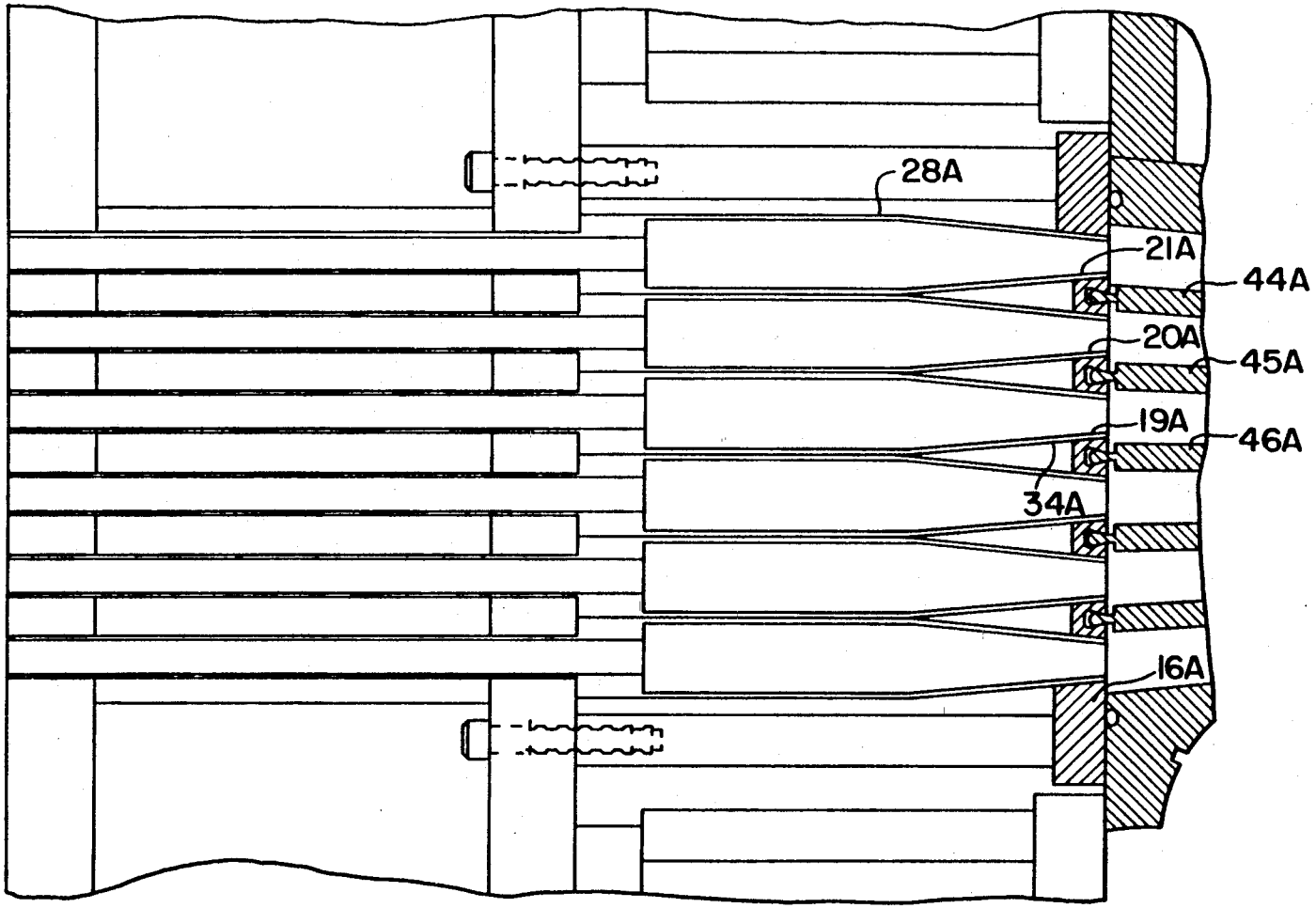
FIG. 5 is an enlarged sectional view of a headbox tube bank apparatus according to a further embodiment of the present invention.

FIG. 5 is an enlarged sectional view similar to that shown in FIG. 2 but showing a further embodiment of the present invention. In the embodiment shown in FIG. 5, trailing elements 44A,45A and 46A have a relatively constant thickness along the length thereof.

Also, openings 19A,20A and 21A are defined by a frame 16A. The arrangement is such that the downstream orifice or nozzle 34A of each tube is of substantially rectangular configuration for progressively improving the uniformity, stability and cleanliness, and for lowering the turbulence of the stock during flow thereof through the downstream portion 28A of each tube.

The present invention provides a unique configuration of tubes for a tube bank apparatus of a headbox which enables the even distribution of stock into a slice chamber while maintaining cleanliness of the tube bank apparatus and a compact configuration of tubes for distributing such stock.

What is claimed is:

1. A headbox tube bank apparatus for the flow therethrough of stock in a papermaking machine, said apparatus comprising:

a tube bank frame for rigidly supporting the tube bank, said frame defining a plurality of openings;

a plurality of tubes cooperating with said frame such that each tube of said plurality of tubes extends through and is supported by an opening of said plurality of openings;

each tube of said plurality of tubes having an upstream and a downstream portion, the arrangement being such that the stock flows through said tube from said upstream to said downstream portion;

said upstream portion defining an internal crossmachine direction section of substantially circular configuration for maximizing the velocity of the stock through said tube;

said downstream portion having a first and a second end, said downstream portion converging towards said second end thereof;

said first end of said downstream portion defining an internal cross-machine direction section of substantially circular configuration greater than the cross-machine direction circular section of the upstream portion and being connected to said upstream portion; and said second end of said downstream portion defining a downstream orifice having a flow area in a cross-machine direction which is of substantially flattened rectangular configuration for progressively increasing the uniformity, stability, cleanliness, and for lowering the turbulence of the stock during flow thereof through said downstream portion, said downstream portion being an integral continuous element.

2. A headbox tube bank apparatus as set forth in claim wherein said frame extends in a cross-machine direction across the flow of stock.

3. A headbox tube bank apparatus as set forth in claim 2 wherein said plurality of openings include:

a plurality of vertically spaced rows.

4. A headbox tube bank apparatus as set forth in claim 3 wherein each row of said plurality of spaced rows includes:

at least two openings, said openings being spaced closely adjacent each other.

5. A headbox tube bank apparatus as set forth in claim 4 wherein said opening of each row are vertically 6. A headbox tube bank apparatus as set forth in claim 3 wherein each vertically spaced row of said plurality of spaced rows is disposed relative to an adjacent row for defining therebetween a dove-tail shaped slot which extends substantially horizontally in a cross-machine direction across the tube bank apparatus.

7. A headbox tube bank apparatus as set forth in claim 6 further including:

a plurality of trailing elements, each trailing element having an upstream and a downstream end, said upstream end defining an anchoring portion for slidable cooperation within said dove-tail shaped slot for movably anchoring said upstream end of said trailing element relative to said tube bank frame.

8. A headbox tube bank apparatus as set forth in claim 7 wherein said upstream ends of said trailing elements increase in thickness immediately downstream relative to said anchoring portion in a direction towards said downstream end of said trailing elements for optimizing the stability and dispersion and cleanliness of stock immediately downstream relative to said downstream orifice.

9. A headbox tube bank apparatus as set forth in claim 1 wherein said upstream portion includes:

an upstream and a downstream end;

said circular configuration being substantially the same from said upstream to said downstream end of said upstream portion.

10. A headbox tube bank apparatus as set forth in claim 9 wherein said first end of said downstream portion is connected to said upstream portion between said upstream and said downstream end of said upstream portion.

11. A headbox tube bank apparatus as set forth in claim 9 wherein said downstream portion further includes:

a cylindrical channel extending from said first end of said downstream portion towards said second end of said downstream portion, said cylindrical channel receiving therein said downstream end of said upstream portion such that said first end of said downstream portion is connected to said upstream portion between said upstream and said downstream ends of said upstream portion.

12. A headbox tube bank apparatus as set forth in wherein said downstream portion between said downstream end of said upstream portion and said second end of said downstream portion further includes:

an upstream length having a substantially uniform flow area in a cross-machine direction along the length thereof;

a downstream length having a flow area in a cross-machine direction which is substantially rectangular and which decreases along the length thereof towards said second end of said downstream portion.

13. A headbox tube bank apparatus as set forth in claim 1 wherein said plurality of tubes is a structural member in a headbox support framework.

14. A method for directing the flow of stock through a tube bank apparatus of a headbox, said method comprising the steps of:

conducting the flow of stock through an upstream portion of a tube of the tube bank apparatus, the upstream portion having a substantially circular cross-sectional flow area along the length thereof for increasing the velocity of the flow of stock therethrough;

reducing the velocity of the stock during movement through an upstream length of a downstream portion of the tube, the upstream length having a substantially circular cross-sectional flow area along the length thereof, the circular flow area of the upstream length being greater than the circular flow area of the upstream portion; and changing the cross-sectional flow area from the circular flow area defined by the upstream length of the downstream portion to a substantially converging flattened rectangular cross-sectional flow area along the length of a downstream length of the downstream portion such that the stock flows uniformly through the tube while inhibiting any tendency for the flow of stock adhering to a side wall of the downstream length, the downstream length converging along the length thereof in the flow direction for inhibiting such adherence, said downstream portion being an integral continuous element.

* * * * *